US005211813A

United States Patent [19]

Sawley et al.

[11] Patent Number: 5,211,813

[45] Date of Patent: May 18, 1993

[54] STEAM SHOWER WITH REDUCED CONDENSATE DRIP

[76] Inventors: David J. Sawley, 1706-2008 Fullerton Ave., North Vancouver BC V7P 3G7, Canada; Warren Woodman, 1184 Shelter Cres, Coquitlam BC V3B 5Y5, Canada

[21] Appl. No.: 773,566

[22] PCT Filed: Mar. 9, 1990

[86] PCT No.: PCT/CA90/00078

§ 371 Date: Nov. 7, 1991

§ 102(e) Date: Nov. 7, 1991

[87] PCT Pub. No.: WO91/14045

PCT Pub. Date: Sep. 19, 1991

[51] Int. Cl.[5] ..... D21F 7/00

[52] U.S. Cl. ..... 162/207; 34/23; 34/155; 162/290

[58] Field of Search ..... 162/290, 375, 207; 34/155, 160, 23

[56] References Cited

U.S. PATENT DOCUMENTS

| | | | |
|---|---|---|---|
| 4,253,247 | 3/1981 | Bergstrom | 34/155 |
| 4,268,976 | 5/1981 | Dove | 162/290 |
| 4,320,583 | 3/1982 | Dove | 162/375 |
| 4,351,700 | 9/1982 | Dove | 162/290 |
| 4,422,575 | 12/1983 | Dove | 239/562 |
| 4,543,737 | 10/1985 | Boissevain | 34/92 |
| 4,545,857 | 10/1985 | Wells | 162/252 |
| 4,580,355 | 4/1986 | Boissevain | 34/54 |
| 4,915,788 | 4/1990 | Winheim | 162/207 |
| 5,020,469 | 6/1991 | Boissevain | 118/67 |

FOREIGN PATENT DOCUMENTS

275914A3 1/1988 European Pat. Off. .

*Primary Examiner*—Karen M. Hastings
*Attorney, Agent, or Firm*—Townsend and Townsend

[57] ABSTRACT

A steam shower to supply steam to a web passing beneath it. There is a main supply header and a preheat chamber enclosing the main supply header. The steam is proportioned between the preheat chamber and the main supply header. There are at least two chambers to receive steam in sequence from the main supply header. In a preferred embodiment the at least two chambers are divided into compartments along the length of the shower. Profiling valves control flow from the main supply header to the first chamber in this preferred embodiment. There are outlets in the last of the at least two chambers through which steam passes to the web.

16 Claims, 3 Drawing Sheets

STEAM SHOWER WITH REDUCED CONDENSATE DRIP

This invention relates to a steam shower.

Steam showers are much used in the manufacturing of paper. They are used to apply steam to a paper sheet passing beneath. The application of steam is to increase the temperature of the sheet to facilitate the removal of the water from the sheet, that is to facilitate its drying to form the paper, principally by decreasing the viscosity of the water in the sheet to facilitate drainage. In other applications the shower is used to improve and control the mixture and other sheet property profiles of the web by the addition of heat and water.

A product available under the trade mark Calendizer from Devron-Hercules Inc. is an example of a steam shower normally used prior to the calendaring of the paper. It is designed to operate on a paper or board machine to improve sheet surface properties. It is designed for steam flow rates in the range 0.02 to 0.04 tonnes of steam per tonne of paper going on to the reel of the papermaking machine. The maximum steam pressure to the shower is 15 psig.

A typical problem with the equipment operating at the above temperatures and pressures is the dripping of condensate on to the sheet. With a shower positioned directly above the sheet the problem is severe and difficult to overcome. The dripping of condensate on to the sheet has an undesirable effect on the sheet.

The present invention seeks to provide an apparatus that avoids the problem of condensate drip.

Accordingly, the present invention is a steam shower to supply steam to a web passing beneath and comprising:

a main supply header;

a preheat chamber enclosing said header;

means to proportion steam flow between the preheat chamber and the main supply header;

at lest two chambers to receive steam in sequence from said main supply header;

means dividing the at least two chambers into compartments along the length of the shower;

a plurality of profiling valves to control flow from the main supply header to the first chamber; and outlets in the last of the at least two chambers through which steam passes to the web.

When the incoming steam is wet it is preferred that there be three chambers to receive steam in sequence from the main supply header. It is also preferred to have means to increase the surface area within the second chamber to trap condensate.

In a further preferred aspect there is a fourth chamber, beneath the second chamber. A passageway between the second and fourth chambers allows condensate to pass from the second to the fourth chamber. Typically, the fourth chamber is common to all compartments of the second chamber, that is it is not divided into compartments along the length of the shower.

A fifth chamber is desirably provided adjacent the outlets of the third chamber and receives a direct steam supply. It is particularly preferred that the fifth chamber and the preheat chamber are both adjacent to each other and to the outlets of the third chamber whereby steam leaving the outlets is heated by contact with the exterior of the fifth chamber in particular but also of the preheat chamber.

BRIEF DESCRIPTION OF THE DRAWINGS

The invention is illustrated in the drawings, in which:

The drawings show a steam shower able to supply steam to a web (not shown) passing beneath it and comprising, as shown particularly in FIG. 2, a main supply header 10. There is a preheat chamber 12 enclosing in the header 10 and an additional compartment 14, containing insulation, is positioned around a substantial part of the exterior of the preheat chamber 12. As shown in FIG. 1 there is a main steam pipe 16 for steam controlled by a main valve 18 and feeding steam to the preheat chamber 12. The apparatus includes a valve 20 to proportion steam flow between the pipe 16 and a branch pipe 22 that feeds the main supply header 10. There is a first chamber 24, second chamber 25 and a third chamber 26 enclosed by the preheat chamber 12 and beneath the main supply header 10. These three chambers 24, 25 and 26 are divided in baffles 27 into a plurality of compartments along the length of the shower, that is in the cross-machine direction when the shower is in use applying steam to a web. The number of compartments will depend on how precisely the profile is to be controlled.

Figure 1:
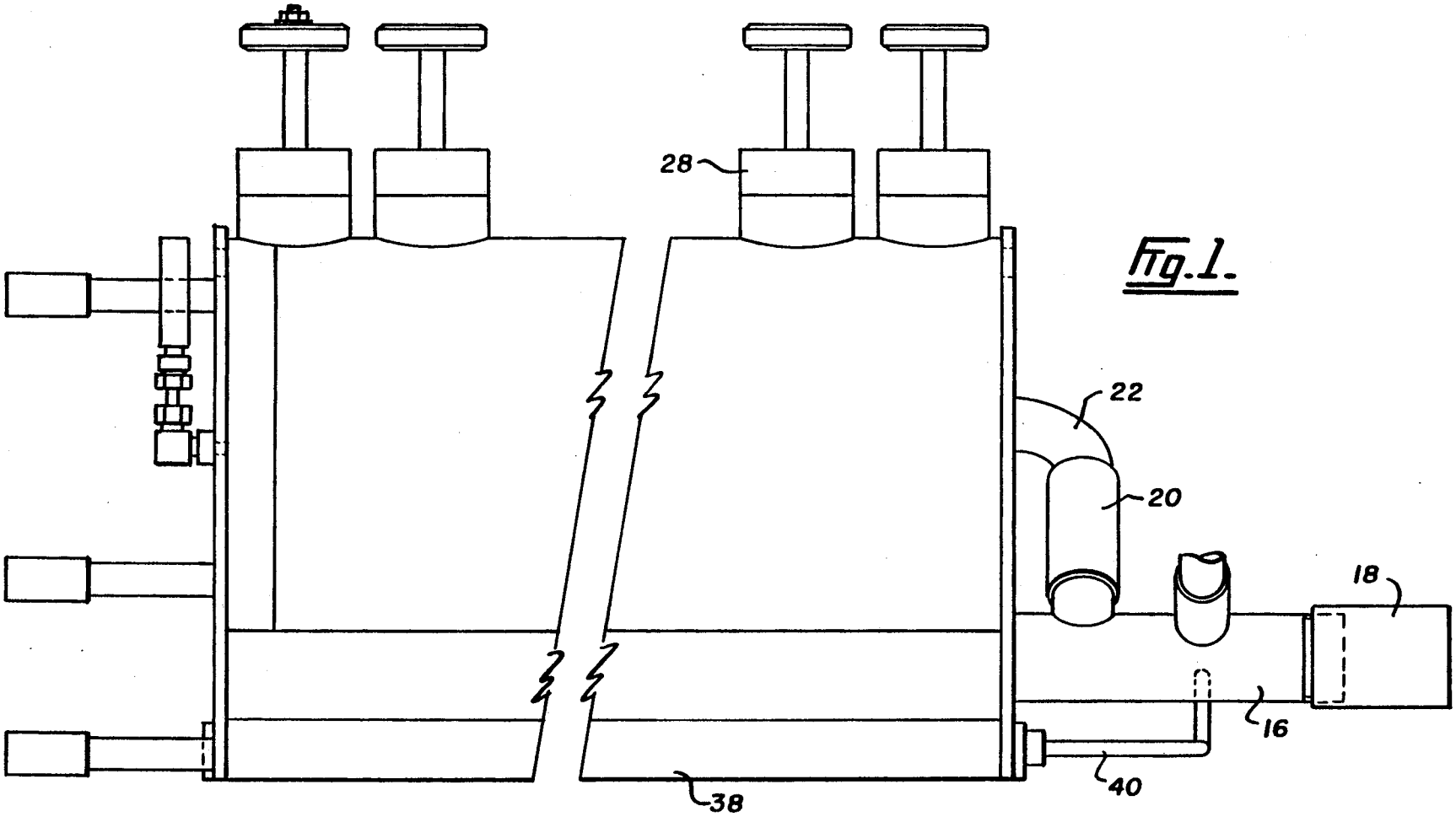
FIG. 1 is side elevation of a steam shower according to the present invention.

A plurality of profiling valves 28 control flow from the main supply header 10 to the first chamber 24. These profiling valves 28 are preferably pneumatically operated plug valves able to create a back pressure about 8 to 10 psig.

Such valves are described and claimed in U.S. Pat. No. 4,422,575. The illustrated example of such a valve comprises a slotted plug 29 received in an inner tube 30 located within an outer tube 31 closed by seal 32. There is a connecting rod 33 attached to plug 29 to permit movement of the plug 29 in and out of inner tube 30 to control the flow of steam between the tubes 30 and 31.

There is a fourth chamber 34 beneath the second chamber 25 and a passageway 36 between the second chamber 25 and fourth chamber 34 allows condensate to pass from the second to the fourth chambers. The fourth chamber 34 is free of baffles, that is it is not divided into compartments, and is common to all compartments of the second chamber 25.

In the illustrated preferred embodiment there is a fifth chamber 38 positioned below the fourth chamber 34. As shown in FIG. 1 there is a steam supply to the fifth chamber 38 through pipe 40. In the preferred embodiment and as most clearly shown in FIG. 2, the fifth chamber 38 and the preheat chamber 12 are both adjacent to each other and define a relatively narrow path 42 way through which the steam must pass from the shower.

The steam flow in the shower is through pipe 16 into the preheat chamber 12. A proportion of steam from the supply pipe 16 is fed off, as controlled by valve 20, into pipe 22 and then into main supply header 10. Each valve 28 controls a plug 29. Movement of plug 29 closes, partially opens or completely opens the top of inner tube 30. When the top of inner tube 30 is open steam passes upwardly from outer tube 31 downwardly into inner tube 30 and through the open, lower end of inner tube 30 into first chamber 24. From chamber 24 steam passes through passageway 48 into second chamber 25. It passes from second chamber 25 through openings 50 into third chamber 26. Openings 52 in the base of the chamber 26 pass the steam to the web passing beneath. As is conventional drainage 54 pipes for condensate are provided. It should also be noted that second chamber 25 is filled with means to increase its surface area, typically in the form of metal mesh 56 to act to trap condensate.

To operate the steam shower according to the present invention, steam is passed to the preheat chamber 12 for a period of approximately 25 minutes at start-up. This avoids initial condensation problems by heating the internal surface of the main supply header 10 and chambers 24, 25 and 26 to a certain temperature above the condensing temperature of the steam.

When the warm-up phase is complete steam is admitted to the remainder of the apparatus.

Steam supplied to the shower is controlled to 14 psig. After the valve 18 steam is sub-divided so that it is passed to the preheat chamber 12 which is generally maintained at or close to 14 psig. Steam is passed to the main supply header 10 through valve 20 and branch pipe 22 which is controlled to a steam pressure independent of and less than the preheat chamber by the valve 20. Typically the main supply header is operated at 8 to 10 psig. Steam also passes through pipe 40 to the fifth chamber 34. Steam flow is such that the preheat steam flowing into the preheat chamber 12 flows across the shower from the inlet side, on the right of FIG. 1, to the outlet side, on the left of FIG. 1, where it exits through drain valves under trap. Flow rate can be adjusted by valves on the condensate drains.

Steam entering the main supply header 10 is reduced in velocity and any condensate and water droplets fall out of the main flow, settle to the bottom of the header and are forced out through the drains 54. The steam is then distributed to the profiling valves 28 which control the flow to the sheet by controlling flow to the individual compartments. As indicated the valves are typically plug-type valves operated by a pneumatic diaphragm actuator. The valve size is designed to create a back pressure of 8 to 10 psig at the required flow rate.

Figure 2:
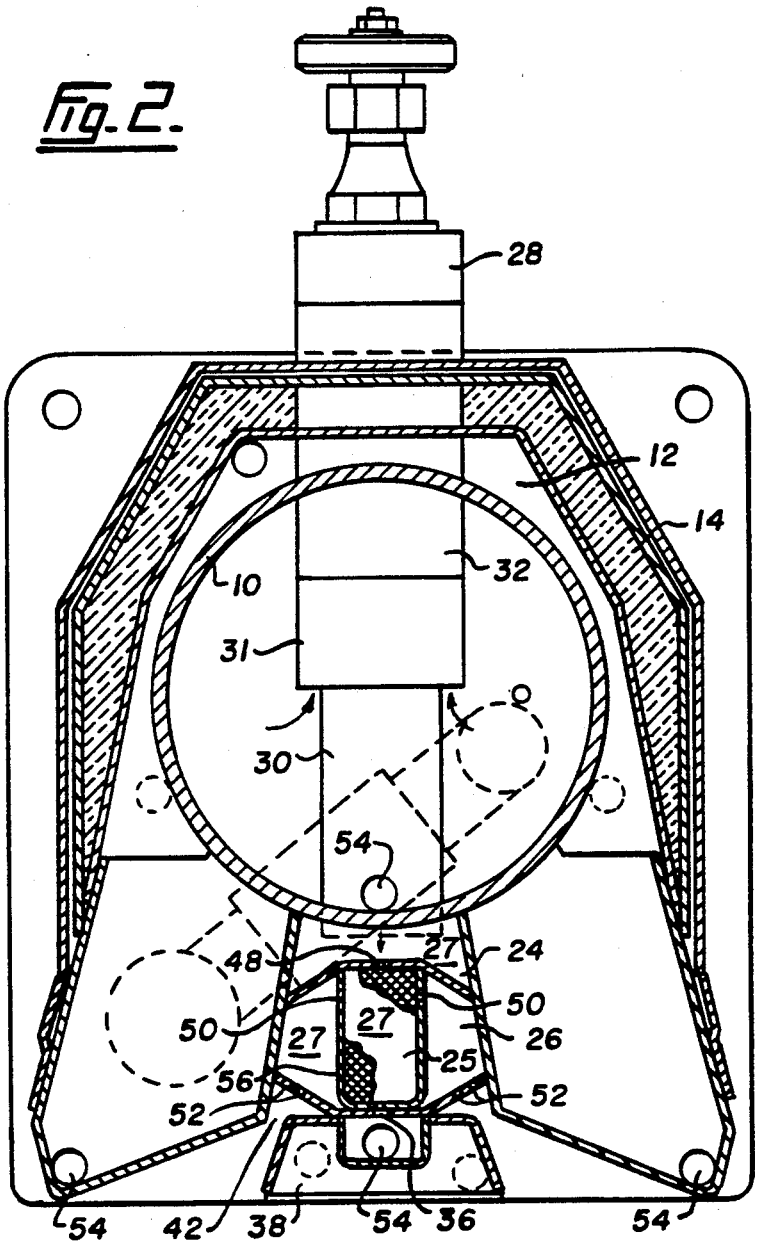
FIG. 2 is sectional end elevation.
Figure 2A:
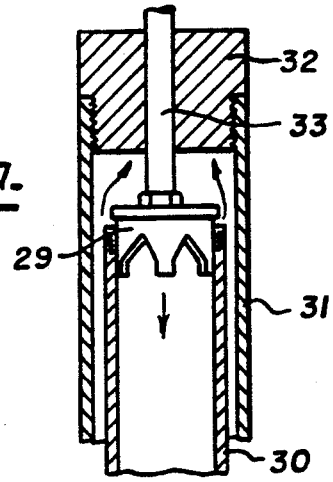
FIG. 2*a* is a detail of the steam shower.
Figure 3:
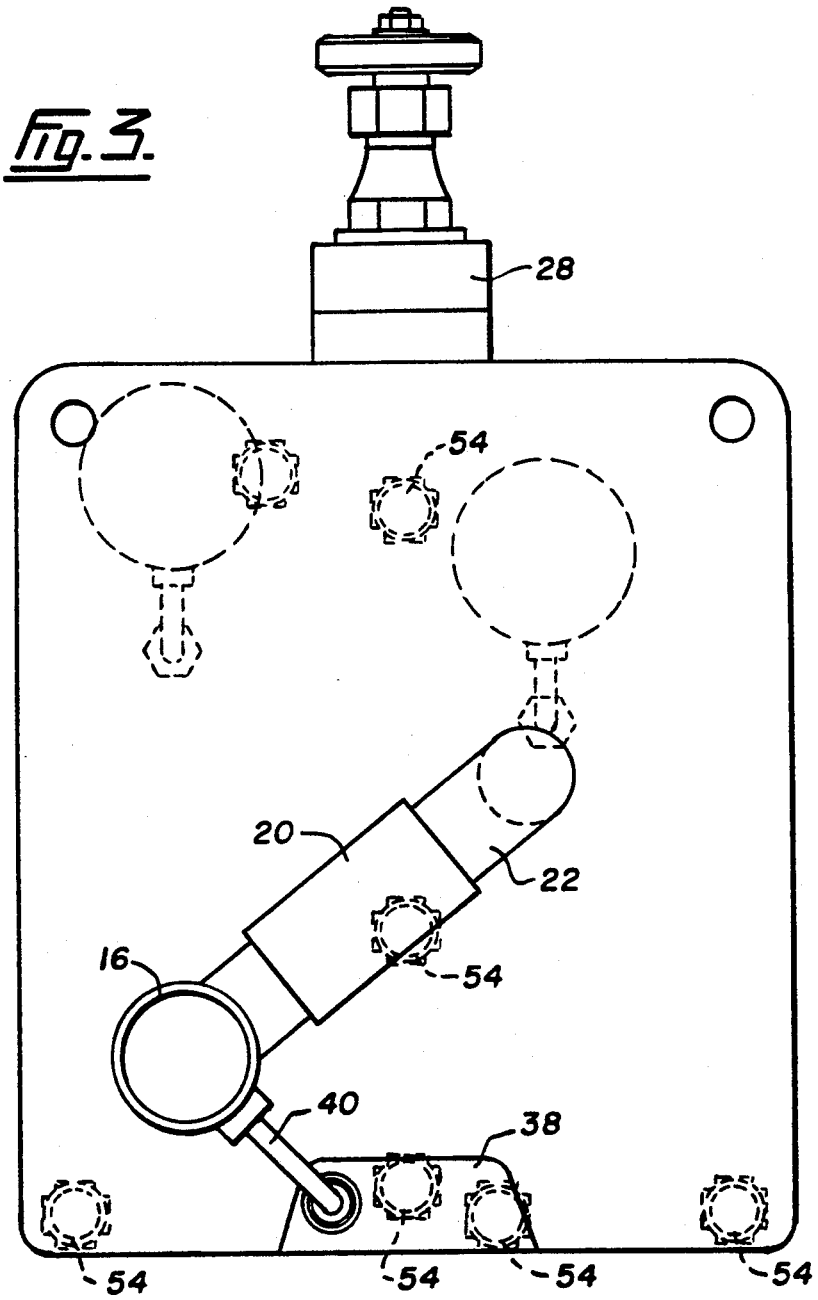
FIG. 3 is an end elevation.

The steam flows through the valve body from the main supply header 10 to the first chamber 24, from there to the second chamber 25 to the third chamber 26 out through outlets 52. As can be seen in FIG. 2, outlets 52 are adjacent to an exterior wall of the preheat chamber 12 so that the steam leaving the outlets 52 is heated by contact with the exterior wall of the preheat chamber 12. The three chambers 24, 25 and 26 sequentially reduce the steam pressure from about 2 psig down to atmospheric. At the same time the steam is scrubbed of remaining entrained moisture by the reduction of pressure and by the presence of the wire mesh in second chamber 25. Condensate drains through opening 36 into the chamber 34 and out through drain 54.

Dry steam flows out through the openings of the third chamber 26. Typically the velocity is about 60 feet per second. The steam is emitted from the shower on to the travelling web and is at or very close to saturated temperature at atmospheric pressure. The steam rapidly condenses on the sheet surface and gives up its latent heat of vaporization. The resulting layer of surface moisture, combined with the sheet temperature increase, produces an improvement in surface properties in excess of that attained without steam application. At the same time the profile of these properties can be controlled in the cross machine direction by operation of profiling valves 28. Steam passing from the shower is reduced from 8 to 10 psig internally close to the point of application to the sheet. The increase in super heat that results from the pressure reduction dries up the steam sufficiently so that no condensate is carried through on to the sheet.

However, the preheat chamber 12 is operated at a higher temperature than the remainder of the apparatus because of the higher steam pressure inside the preheat chamber 12. Furthermore the presence of fifth chamber 38 acts as a final means of removing any small quantity of condensate which may find its way through outlets. As this chamber is at the same pressure of the preheat chamber, that is 14 psig, its temperature is approximately 248° F. which is higher than the steam temperature leaving the outlets 52. Thus, any small droplets will be evaporated.

The present invention thus provides a steam shower that avoids the problems of dripping on to the paper sheet from the steam shower.

A profiling system is described in the above but it should be understood that the present invention can also be used in a non-profiling mode that is, by not dividing the various chambers into compartments. Each chamber would consist of a single compartment extending right across the width of the sheet in the cross machine direction. Furthermore, the shape of the steam shower facing the web can also be contoured to partially enclose the web as it travels around a papermachine element such as a roll or drum.

We claim:

1. A steam shower to supply steam to a web passing beneath and comprising:

means defining a steam supply;

a main supply header;

a preheat chamber enclosing said header;

pipe means to direct steam from the steam supply to the preheat chamber on the one hand and to the main supply header on the other hand and means located in said pipe means to proportion steam flow between the preheat chamber and the main supply header;

at least first and second chambers independent of the preheat chamber and arranged to receive steam in sequence from said main supply header; and outlets in the last of the at least first and second chambers through which steam passes to the web, said outlets being adjacent to at least one exterior wall of the preheat chamber and structured and arranged so that steam leaving the outlets is heated by contact with the at least one exterior wall of the preheat chamber.

2. A method for operating the steam shower of claim 1 comprising the steps of:

a) applying steam to the shower at about 14 psig;

b) operating said means for proportioning steam flow so as to supply steam to the main header at about 8 to 10 psig and to the preheat chamber at about 14 psig.

3. A steam shower to supply steam to a web passing beneath and comprising:

means defining a steam supply;

a main supply header;

a preheat chamber enclosing said header;

pipe means to direct steam from the steam supply to the preheat chamber on the one hand and to the main supply header on the other hand and means located in said pipe means to proportion steam flow between the preheat chamber and the main supply header;

at least first and second chambers independent of the preheat chamber and arranged to receive steam in sequence from said main supply header;

means dividing the at least first and second chambers into compartments along the length of the shower;

a plurality of profiling valves to control flow from the main supply header to the compartments; and outlets in the last of the at least first and second chambers through which steam passes to the web, said outlets being adjacent to at least one exterior wall of the preheat chamber structured and arranged so that steam leaving the outlets is heated by contact with the at least one exterior wall of the preheat chamber.

4. A shower as claimed in claim 3 wherein said at least first and second chambers includes a third chamber, said third chamber being the last chamber to receive steam in sequence, and means dividing said third chamber into compartments along the length of the shower.

5. A shower as claimed in claim 4 including a fourth chamber, beneath the second, and a passageway between the second and fourth chambers to allow condensate to pass from the second to the fourth chamber.

6. A shower as claimed in claim 5 in which the fourth chamber is free of compartments and is common to all compartments of the second chamber.

7. A shower as claimed in claim 5 including a fifth chamber whose outer surface is adjacent the outlets of the third chamber and means for supplying steam to said fifth chamber.

8. A shower as claimed in claim 7 in which the fifth chamber and the preheat chamber are both adjacent to each other and to the outlets of the third chamber whereby steam leaving the outlets is heated by contact with the exterior of both the preheat and firth chambers.

9. A shower as claimed in claim 8 wherein said means for supplying steam to said fifth chamber comprises a branch line from said main supply header to feed steam to said fifth chamber.

10. A shower as claimed in claim 4 in which the first, second and third chambers are structured and arranged to reduce the steam pressure sequentially from the first chamber to the outlets of the third chamber.

11. A method of operating the steam shower of claim 10 wherein steam is introduced to the shower at a pressure such that the pressure of the steam at the outlets is about atmospheric pressure.

12. A shower as claimed in claim 4 in which the outlets in the third chamber comprise a plurality of openings dimensioned to create steam velocity of about 60 ft. per second.

13. A shower as claimed in claim 3 including means to increase the internal surface area of the second chamber.

14. A shower as claimed in claim 13 in which the means to increase the internal surface area of the second chamber comprises wire mesh placed in the chamber.

15. A shower as claimed in claim 3 in which the profiling valves are plug valves.

16. A method of operating the steam shower of claim 3 comprising the steps of:

a) applying steam to the shower at about 14 psig;

b) operating said means for proportioning steam flow so as to supply steam to the main header at about 8 to 10 psig and to the preheat chamber at about 14 psig, c) operating said profiling valves to create a back pressure of 8 to 10 psig into said chambers.

* * * * *